US008549856B1

(12) United States Patent
Cepedarizo et al.

(10) Patent No.: US 8,549,856 B1
(45) Date of Patent: Oct. 8, 2013

(54) ENERGY HARVESTING SYSTEMS AND METHODS OF ASSEMBLING SAME

(75) Inventors: Juan Cepedarizo, Long Beach, CA (US); Gam B. Ganapathi, La Cresenta, CA (US)

(73) Assignee: The United States of America as Represented by the Administrator of the National Aeronautics and Space Administration, Washington, DC (US)

( * ) Notice: Subject to any disclaimer, the term of this patent is extended or adjusted under 35 U.S.C. 154(b) by 317 days.

(21) Appl. No.: 12/902,883

(22) Filed: Oct. 12, 2010

(51) Int. Cl.
*F02G 3/00* (2006.01)

(52) U.S. Cl.
USPC ..... 60/616; 60/618; 60/620

(58) Field of Classification Search
USPC ..... 60/616, 618, 620
See application file for complete search history.

(56) References Cited

U.S. PATENT DOCUMENTS

| | | | | |
|---|---|---|---|---|
| 6,047,767 | A * | 4/2000 | Bodhaine et al. | 165/141 |
| 6,581,384 | B1 | 6/2003 | Benson | |
| 2005/0214109 | A1* | 9/2005 | Grande et al. | 415/90 |
| 2007/0278795 | A1* | 12/2007 | Berkson | 290/4 C |
| 2009/0056916 | A1 | 3/2009 | Yesin et al. | |
| 2009/0260361 | A1 | 10/2009 | Prueitt | |
| 2010/0079952 | A1 | 4/2010 | Liang et al. | |
| 2010/0156111 | A1* | 6/2010 | Pesce et al. | 290/1 A |

* cited by examiner

*Primary Examiner* — Thomas Denion
*Assistant Examiner* — Brian Inacay
(74) *Attorney, Agent, or Firm* — Mark Homer

(57) ABSTRACT

A method of assembling an energy harvesting system is provided. The method includes coupling at least one energy storage device in flow communication with at least one apparatus that is configured to generate thermal energy and to transfer the thermal energy into at least one fluid stream. The energy storage device is configured to store the fluid stream. Moreover, the method includes coupling at least one fluid transfer device downstream from the energy storage device. The fluid transfer device receives the fluid stream from the energy storage device. A bladeless turbine is coupled in flow communication with the fluid transfer device, wherein the bladeless turbine receives the fluid stream to generate power.

12 Claims, 3 Drawing Sheets

ENERGY HARVESTING SYSTEMS AND METHODS OF ASSEMBLING SAME

STATEMENT OF GOVERNMENT INTEREST

The invention described hereunder was made in the performance of work under a NASA contract, and is subject to the provisions of Public Law #96-517 (35 U.S.C. 202) in which the Contractor has elected not to retain title.

BACKGROUND OF THE INVENTION

The field of the invention relates generally to energy harvesting systems and, more particularly, to energy harvesting systems that convert waste heat to power using a bladeless turbine or a boundary layer turbine.

Waste heat is generated from machines, electrical equipment and industrial processes for which there exists no useful application and is often regarded as a waste by-product. For example, waste heat can be generated from steel mills, concrete plants, smokestacks, and automobile exhausts. Moreover, waste heat can be harvested for power. At least some known systems that harvest waste heat for power use steam turbine engines to convert heat to power by extracting thermal energy from pressurized steam prior to converting the energy into rotary motion used to drive a generator. Known generators convert the mechanical energy into electrical power.

However, the process of converting thermal energy into electrical power via such systems is generally inefficient. Specifically, to generate a large amount of power from thermal energy, a relatively high temperature heat is required. Although, heat losses in such a process contribute greatly to the overall efficiency of the system, the high temperatures are necessary to ensure operation of the system. For example, in at least some known steam turbine engines, the turbines are not operable with liquid flow as liquid may damage the turbine and lead to erosion of the components of the turbine. As such, known energy harvesting systems require additional heating technology, such as superheaters, to ensure any fluid flow is vaporized to steam prior to any flow entering the turbine. Therefore, the cost effectiveness and/or operational efficiency of known energy harvesting systems may be limited.

BRIEF DESCRIPTION OF THE INVENTION

In one embodiment, a method of assembling an energy harvesting system is provided. The method includes coupling at least one energy storage device in flow communication with at least one apparatus that is configured to generate thermal energy and to transfer the thermal energy into at least one fluid stream. The energy storage device is configured to store the fluid stream. Moreover, the method includes coupling at least one fluid transfer device downstream from the energy storage device. The fluid transfer device receives the fluid stream from the energy storage device. A bladeless turbine is coupled in flow communication with the fluid transfer device, wherein the bladeless turbine receives the fluid stream to generate power.

In another embodiment, an energy harvesting system is provided. The energy harvesting system includes at least one apparatus configured to generate thermal energy and to transfer the thermal energy into at least one fluid stream. The energy harvesting system also includes at least one energy storage device that is coupled in flow communication with the apparatus and the energy storage device is configured to store the fluid stream. Moreover, the energy harvesting system includes at least one fluid transfer device that is coupled downstream from the energy storage device for receiving the fluid stream from the energy storage device. Further, the energy harvesting system includes a bladeless turbine that is coupled in flow communication with the fluid transfer device. The bladeless turbine receives the at least one fluid stream to generate power.

In another embodiment, an energy harvesting system is provided. The energy harvesting system includes at least one apparatus configured to generate thermal energy and to transfer the thermal energy into at least one fluid stream. The energy harvesting system also includes at least one energy storage device that is coupled in flow communication with the apparatus and the energy storage device is configured to store the fluid stream. Moreover, the energy harvesting system includes at least one fluid transfer device that is coupled downstream from the energy storage device for receiving the fluid stream from the energy storage device. Further, the energy harvesting system includes a bladeless turbine that is coupled in flow communication with the fluid transfer device and the bladeless turbine receives the at least one fluid stream to generate power. Moreover, the energy harvesting system includes a condensing device that is coupled in flow communication with the bladeless turbine and with the fluid transfer device.

DETAILED DESCRIPTION OF THE INVENTION

The exemplary methods, apparatus, and systems described herein overcome at least some known disadvantages associated with known energy harvesting systems that use waste heat to generate power. In particular, the embodiments described herein provide a system that is efficient and that can convert waste heat to electrical power at a relatively low temperature. The energy systems described herein each use a bladeless turbine or a boundary layer turbine that receives a fluid stream at a relatively low temperature. More specifically, such a turbine operates with using vapor and/or liquid flow, and does not require additional heating technology, such as superheaters.

Figure 1:
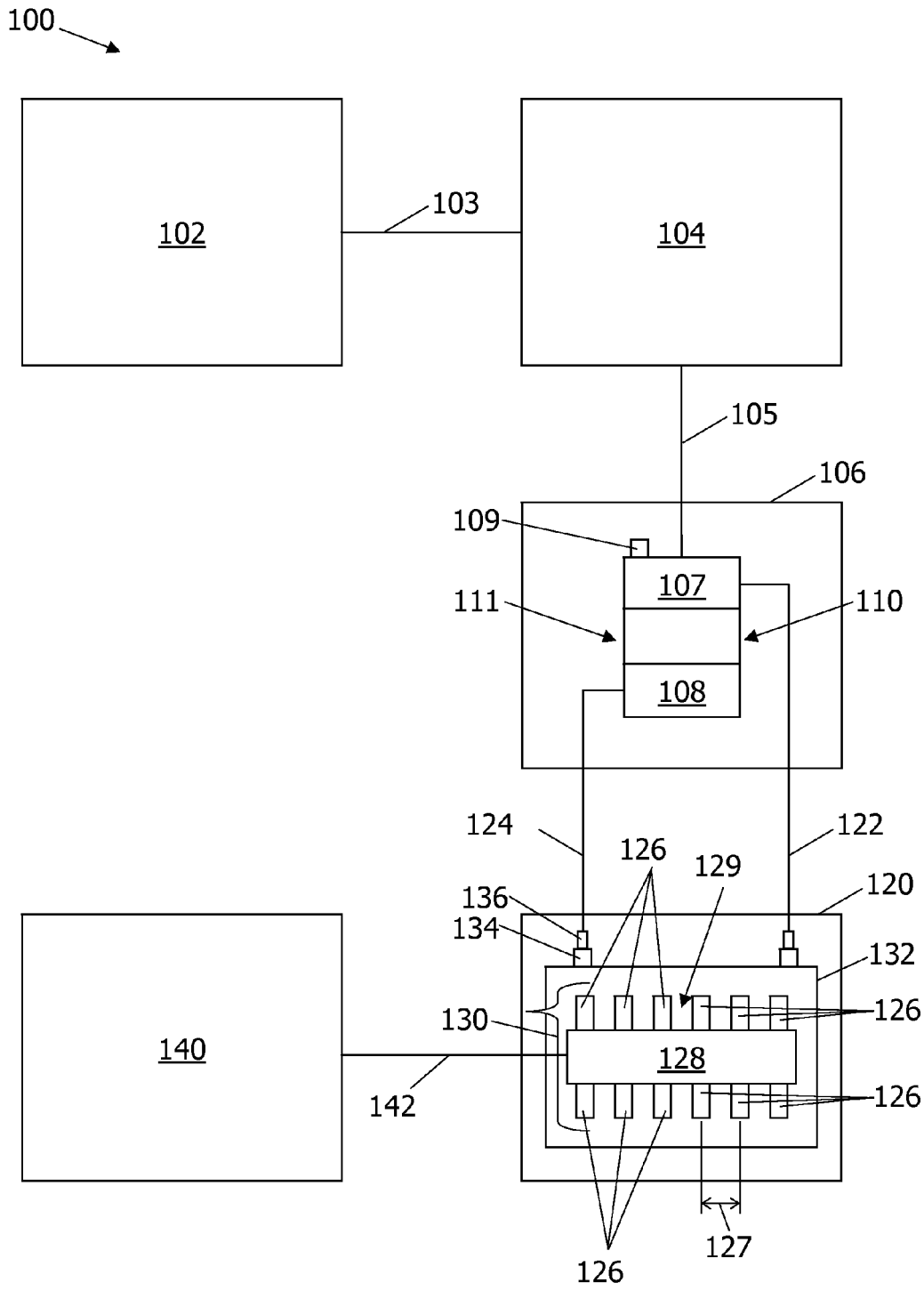
FIG. 1 is a block diagram of an exemplary energy harvesting system.

FIG. 1 illustrates an exemplary energy harvesting system 100. System 100 includes at least one apparatus 102 that generates thermal energy. For example, in the exemplary embodiment, apparatus 102 is an incinerator. Alternatively, apparatus 102 may be any apparatus or device that is configured to or that is enabled to generate thermal energy, and that enables energy system 100 to function as described herein.

Moreover, in the exemplary embodiment, system 100 also includes at least one energy storage device 104 that is coupled in flow communication with apparatus 102 via a fluid channel 103. In the exemplary embodiment, energy storage device 104 is a thermal energy storage device 104 that provides a continuous source of heat via a fluid stream.

System 100 includes at least one fluid transfer device 106 that is coupled downstream from the energy storage device 104 via a fluid channel 105. In the exemplary embodiment, fluid transfer device 106 is a loop heat pipe. Alternatively, fluid transfer device 106 may be any type of device configured to transfer fluid and that enables system 100 to function as described herein. For example, fluid transfer device 106 may be any two-phase heat and/or fluid transfer device that is enabled to use capillary action to passively transfer fluid, such as a capillary pumped loop or a thermosyphon, and that enables system 100 to function as described herein. Moreover, fluid transfer device 106 may be configured to actively transfer fluid via a pump and that enables system 100 to function as described herein.

More specifically, in the exemplary embodiment, the fluid transfer device 106 includes an evaporator 107, a condenser 108, and a compensation chamber 109. Evaporator 107 and condenser 108 are coupled to each other via a fluid channel 110 and a fluid channel 111. Moreover, evaporator 107 and compensation chamber 109 each contain at least one wick (not shown).

System 100 also includes a bladeless turbine 120 that is coupled in flow communication with fluid transfer device 106. More specifically, evaporator 107 is coupled to bladeless turbine 120 via a fluid channel 122, and condenser 108 is coupled to bladeless turbine 120 via a fluid channel 124.

In the exemplary embodiment, bladeless turbine 120 is a Tesla turbine. Alternatively, bladeless turbine 120 may be any turbine that enables system 100 to function as described herein. More specifically, in the exemplary embodiment, bladeless turbine 120 includes a plurality of disks 126 that are coupled to a rotor shaft 128 to form a rotor 130. Each disk 126 includes a central opening (not shown) extending therethrough, and shaft 128 extends through each disk opening such that each disk 126 substantially surrounds shaft 128. Moreover, the disk openings are in flow communication with each other, such that at least one exhaust port (not shown) is defined between disks 126 and shall 128. Further, each disk 126 is spaced a predetermined distance 127 from each other such that a flow path 129 is defined between adjacent disks 126.

Bladeless turbine 120 also includes a stationary element 132 at least partially circumscribing rotor 130 such that stationary element 132 and rotor at least partially define a cavity (not shown) between them. Stationary element 132 includes at least one inlet 134. More specifically, in the exemplary embodiment, stationary element 132 includes two inlets 134, wherein each inlet 134 is located on opposing ends. Each inlet 134 is coupled to a nozzle 136, and each nozzle 136 is coupled to fluid channel 122 and fluid channel 124. Moreover, bladeless turbine 120 is coupled to a generator 140. More specifically, shaft 128 is coupled to generator 140 via a conduit 142.

During operation, apparatus 102 generates waste heat, such as thermal energy, and transfers the thermal energy into at least one fluid stream. In the exemplary embodiment, the fluid stream is in a liquid and gaseous state. Energy storage device 104 receives the fluid stream via channel 103 and the fluid stream is stored in device 104. When power is needed for system 100, the fluid stream is channeled from energy storage device 104 towards fluid transfer device 106. More specifically, the fluid stream is channeled via fluid channel 105 to evaporator 107. As the fluid stream is channeled to evaporator 107, liquid from the fluid stream is vaporized and a vapor stream is generated from at least a portion of the fluid stream. Moreover, menisci formed in the evaporator wick develop capillary forces that passively channel the vapor stream and/or the remaining fluid stream towards condenser 108 via fluid channel 110. Alternatively, the vapor stream and/or remaining fluid stream can be channeled directly to turbine 120 via fluid channel 122.

If the vapor stream and/or the remaining fluid stream is channeled into condenser 108, condenser 108 generates a liquid stream from the vapor stream and/or the remaining fluid stream channeled therein. The capillary forces passively channel the liquid stream to turbine 120 via fluid channel 124.

Alternatively, the liquid stream and/or remaining fluid stream may be recirculated back into the evaporator 107. Specifically, in such an instance, the liquid stream and/or remaining fluid streams are channeled via fluid channel 111 into the evaporator 107. The compensation chamber 109 stores excess liquid and controls the operating temperature of fluid transfer device 106.

Bladeless turbine 120 receives the fluid stream from fluid transfer device 106 via either fluid channel 122 or via fluid channel 124. More specifically, the fluid stream is channeled from fluid channel 122 and/or fluid channel 124 into nozzles 136 at inlets 134. The fluid stream is then channeled between disks 126 such that flow path 129 is defined between adjacent disks 126. The fluid stream is then channeled through the exhaust ports defined through the disk openings. The fluid stream channeled between disks 126 induces rotation of disks 126 and shaft 128. The mechanical energy is then converted into electricity via generator 140 coupled to shaft 128. Thus, the liquid and/or vapor channeled to turbine 120 creates a rotational force that ultimately produces work from turbine 120.

In the exemplary embodiment, system 100 is efficient and can convert waste heat to electrical power at a relatively low temperature. More specifically, bladeless turbine 120 receives the fluid stream in either a liquid state and/or gaseous state from fluid transfer device 106. As such, bladeless turbine 120 operates with using vapor and/or liquid flow, and does not require additional heating technology, such as superheaters. Moreover, bladeless turbine 120 is able to receive the fluid stream at a relatively low temperature. For example, in one embodiment, bladeless turbine 120 receives the fluid stream at a temperature between about 65° C. to about 500 degrees ° C.

Figure 2:
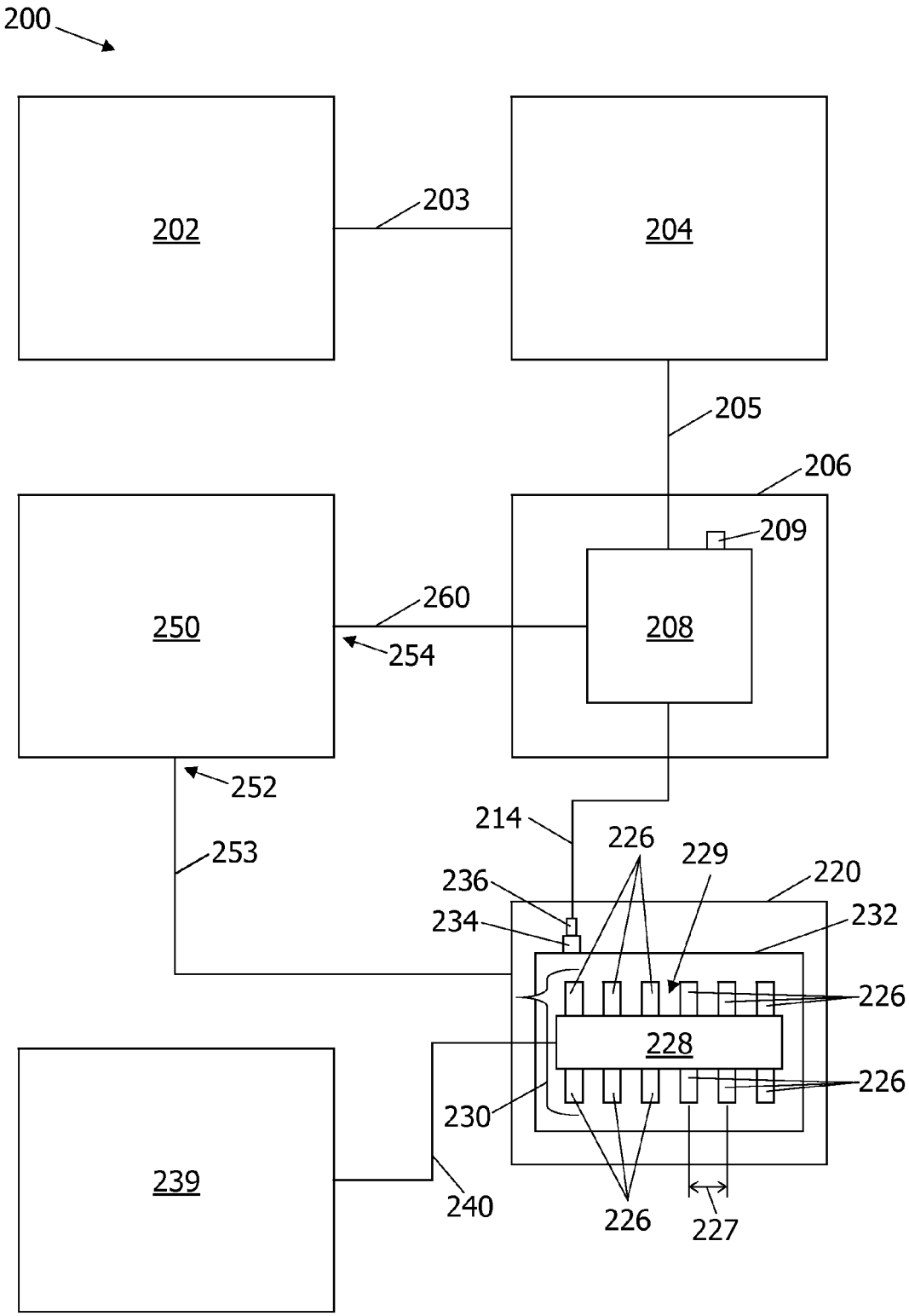
FIG. 2 is a block diagram of an alternative embodiment of an exemplary energy harvesting system.

FIG. 2 illustrates an alternative embodiment of an exemplary energy harvesting system 200. In the exemplary embodiment, system 200 includes at least one apparatus 202 that generates thermal energy. For example, in the exemplary embodiment, apparatus 202 is an incinerator. Alternatively, apparatus 202 may be any apparatus or device that is configured or enabled to generate thermal energy, and that enables energy system 200 to function as described herein.

Moreover, in the exemplary embodiment, system 200 also includes at least one energy storage device 204 that is coupled in flow communication with apparatus 202 via a fluid channel 203. In the exemplary embodiment, energy storage device 204 is a thermal energy storage device 204 that provides a continuous source of heat via a fluid stream.

System 200 includes at least one fluid transfer device 206 that is coupled downstream from the energy storage device 204 via fluid channel 205. In the exemplary embodiment, fluid transfer device 206 includes an evaporator 208 and a compensation chamber 209. Energy storage device 204 is coupled to evaporator 208 via fluid channel 205. Evaporator 208 and compensation chamber 209 each include at least one wick (not shown). Alternatively, fluid transfer device 206 may be any type of device configured to transfer fluid and that enables system 200 to function as described herein. For example, fluid transfer device 206 may be any heat and/or fluid transfer device that is enabled to use capillary action to passively transfer fluid and that enables system 200 to function as described herein. Moreover, fluid transfer device 206 may be configured to actively transfer fluid via a pump (not shown) and that enables system 200 to function as described herein.

System 200 also includes a bladeless turbine 220 that is coupled in flow communication with fluid transfer device 206. More specifically, evaporator 208 is coupled to bladeless turbine 220 via a fluid channel 214. In the exemplary embodiment, bladeless turbine 220 is a Tesla turbine. Alternatively, bladeless turbine 220 may be any turbine that enables system 200 to function as described herein.

More specifically, in the exemplary embodiment, bladeless turbine 220 includes a plurality of disks 226 that are coupled to a rotor shaft 228 to form a rotor 230. Each disk 226 includes a central opening (not shown) extending therethrough, and shaft 228 extends through each disk opening such that each disk 226 substantially surrounds shaft 228. Moreover, the disk openings are in flow communication with each other, such that at least one exhaust port (not shown) is defined between disks 226 and shaft 228. Moreover, each disk 226 is spaced a predetermined distance 227 from each other such that a flow path 229 is defined between adjacent disks 226.

Bladeless turbine 220 also includes a stationary element 232 at least partially circumscribing rotor 230 such that stationary element 232 and rotor 230 at least partially define a cavity (not shown) between them. Stationary element 232 includes at least one inlet 234. Inlet 234 is coupled to a nozzle 236 and nozzle 236 is coupled to fluid channel 214. Moreover, bladeless turbine 220 is coupled to a generator 239. More specifically, shaft 228 is coupled to generator 239 via conduit 240.

Moreover, system 200 includes a condensing device 250 coupled in flow communication with bladeless turbine 220 and with fluid transfer device 206. More specifically, a first end 252 of condensing device 250 is coupled in flow communication with turbine 220 via a fluid channel 253 and a second end 254 is coupled in flow communication with fluid transfer device 206 via fluid channel 260. More specifically, condensing device 250 is coupled to evaporator 208 via channel 260.

During operation, apparatus 202 generates waste heat, such as thermal energy, and transfers the thermal energy into at least one fluid stream. In the exemplary embodiment, the fluid stream is in a liquid and gaseous state. Energy storage device 204 receives the fluid stream and the fluid stream is stored in device 204. When power is needed for the system 200, the fluid stream is channeled from energy storage device 204 towards fluid transfer device 206. More specifically, the fluid stream is channeled via fluid channel 205 to evaporator 208. As the fluid stream is channeled to evaporator 208, liquid from the fluid stream is vaporized and a vapor stream is generated from at least a portion of the fluid stream. Moreover, menisci formed in the evaporator wick develop capillary forces that passively channel the vapor stream and/or the remaining fluid stream towards bladeless turbine 220 via fluid channel 214.

More specifically, the fluid stream is channeled from fluid channel 214 into nozzle 236 at inlet 234. The fluid stream is then channeled between disks 226 such that flow path 229 is defined between adjacent disks 226. Moreover, the fluid stream is channeled through the exhaust ports defined through the openings. The fluid stream channeled between disks 226 induces rotation of disks 226 and shaft 228. The mechanical energy is then converted into electricity via generator 239 coupled to shaft 228. Thus; the liquid and/or vapor channeled to bladeless turbine 220 creates a rotational force that ultimately produces work from bladeless turbine 220.

Any remaining fluid and/or vapor not used by turbine 220 is channeled via fluid channel 253 into condensing device 250. Condensing device 250 condenses a liquid stream from the vapor and the capillary forces passively channel the liquid stream to fluid transfer device 206 via fluid channel 260. More specifically, the liquid stream is recirculated to evaporator 208 via channel 260 such that another fluid stream can be channeled to bladeless turbine 220 to generate power.

In the exemplary embodiment, system 200 is efficient and can convert waste heat to electrical power at a relatively low temperature. More specifically, bladeless turbine 220 receives the fluid stream in either a liquid state and/or gaseous state from fluid transfer device 206. As such, bladeless turbine 220 operates with using vapor and/or liquid flow, and does not require additional heating technology, such as superheaters. Moreover, bladeless turbine 220 is able to receive the fluid stream at a relatively low temperature. For example, in one embodiment, bladeless turbine 220 receives the fluid stream at a temperature between about 65° C. to about 500 degrees ° C. Further, using condensing device 250 after the fluid stream has been channeled through turbine 220 enables system 200 to continue to convert waste heat to electrical power.

Figure 3:
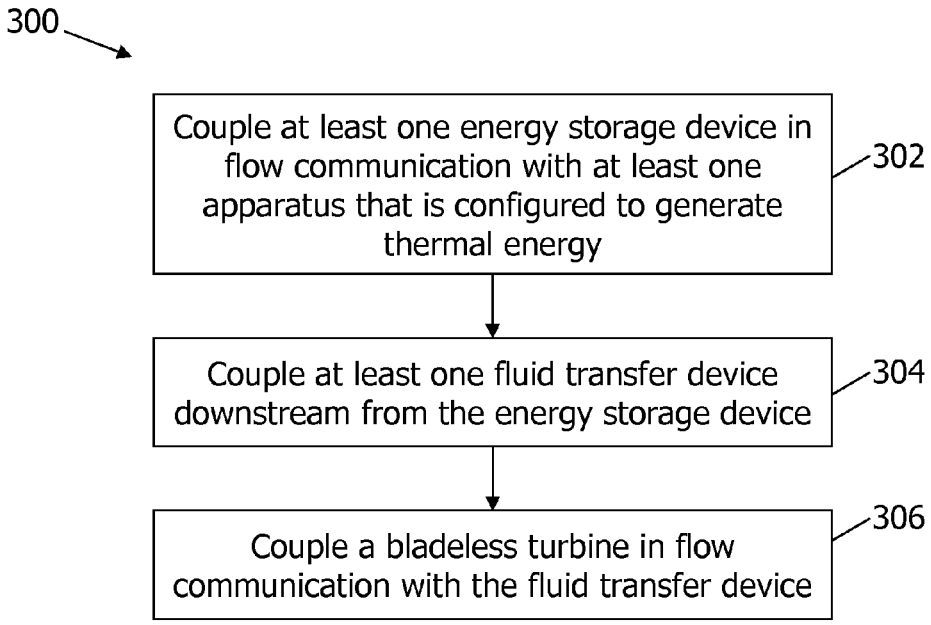
FIG. 3 is an exemplary method of assembling the exemplary energy harvesting systems shown in FIGS. 1 and 2.

FIG. 3 is a flow chart illustrating an exemplary method 300 of assembling an exemplary energy harvesting system, such as energy harvesting system 100 (shown in FIG. 1) and energy harvesting system 200 (shown in FIG. 2). In the exemplary embodiment, at least one energy storage device 104 (shown in FIG. 1) is coupled 302 in flow communication with at least one apparatus 102 (shown in FIG. 1) that is configured to generate thermal energy and to transfer the thermal energy into at least one fluid stream.

Moreover, at least one fluid transfer device 106 (shown in FIG. 1) is coupled 304 downstream from energy storage device 104. Further, a bladeless turbine 120 (shown in FIG. 1) is coupled 306 in flow communication with fluid transfer device 106.

The methods and apparatus for an energy harvesting system as described herein facilitates a system that is efficient and that can convert waste heat to electrical power at a relatively low temperature. The energy systems described herein each use a bladeless turbine or a boundary layer turbine that receives a fluid stream at a relatively low temperature. More specifically, such a turbine operates with using vapor and/or liquid flow, and does not require additional heating technology, such as superheaters.

Exemplary embodiments of an energy harvesting system using a bladeless turbine or a boundary layer turbine are described above in detail. The methods, apparatus, and systems are not limited to the specific embodiments described herein nor to the specific illustrated energy harvesting system. While the invention has been described in terms of various specific embodiments, those skilled in the art will recognize that the invention can be practiced with modification within the spirit and scope of the claims.

Although specific features of various embodiments of the invention may be shown in some drawings and not in others, this is for convenience only. Moreover, references to "one embodiment" in the above description are not intended to be interpreted as excluding the existence of additional embodiments that also incorporate the recited features. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method of assembling an energy harvesting system, said method comprising:

providing an apparatus that generates thermal energy and transfers the thermal energy into at least one fluid stream, the at least one fluid stream being in a both liquid and gaseous states;

coupling at least one fluid transfer device with the apparatus to receive the at least one fluid stream, the fluid transfer device maintaining the at least one fluid stream in both liquid and gaseous states; and coupling a bladeless turbine in flow communication with the at least one fluid transfer device, wherein the bladeless turbine receives the at least one fluid stream, in both liquid and gaseous states, to generate power.

2. A method in accordance with claim 1 further comprising coupling a condensing device in flow communication with the bladeless turbine and with the at least one fluid transfer device.

3. A method in accordance with claim 1 further comprising configuring the at least one fluid transfer device to passively transfer the at least one fluid stream to the bladeless turbine.

4. A method in accordance with claim 1, wherein said coupling a bladeless turbine in flow communication with the at least one fluid transfer device further comprises coupling a bladeless turbine in flow communication with the at least one fluid transfer device, wherein the bladeless turbine receives the at least one fluid stream at a temperature between about 65° C. to about 500° C.

5. A method in accordance with claim 1, wherein said coupling a bladeless turbine in flow communication with the at least one fluid transfer device further comprises coupling a Tesla turbine in flow communication with the at least one fluid transfer device.

6. A method in accordance with claim 1, wherein said coupling at least one fluid transfer device downstream from the at least one energy storage device further comprises coupling a loop heat pipe with at least one thermal energy storage device.

7. An energy harvesting system comprising:

at least one apparatus configured to generate thermal energy and to transfer the thermal energy into at least one fluid stream, the at least one fluid stream being in both liquid and gaseous states;

at least one fluid transfer device coupled with the at least one apparatus, the fluid transfer device maintaining and transferring the at least one fluid stream in both liquid and gaseous states; and a bladeless turbine coupled in flow communication with said at least one fluid transfer device, wherein said bladeless turbine receives the at least one fluid stream, in both liquid and gaseous states, to generate power.

8. An energy harvesting system in accordance with claim 7 further comprising a condensing device coupled in flow communication with said bladeless turbine and with said at least one fluid transfer device.

9. An energy harvesting system in accordance with claim 7, wherein said at least one fluid transfer device is configured to passively transfer the at least one fluid stream to said bladeless turbine.

10. An energy harvesting system in accordance with claim 7, wherein said at least one fluid transfer device is a loop heat pipe.

11. An energy harvesting system in accordance with claim 7, wherein said bladeless turbine receives the at least one fluid stream at a temperature between about 65° C. to about 500° C.

12. An energy harvesting system in accordance with claim 7, wherein said bladeless turbine is a Tesla turbine.

* * * * *

UNITED STATES PATENT AND TRADEMARK OFFICE

CERTIFICATE OF CORRECTION

PATENT NO. : 8,549,856 B1
APPLICATION NO. : 12/902883
DATED : October 8, 2013
INVENTOR(S) : Cepeda-Rizo et al.

It is certified that error appears in the above-identified patent and that said Letters Patent is hereby corrected as shown below:

On the title page, item [75] first inventor's name should read "Juan Cepeda-Rizo" and the second inventor's name should read "Gani B. Ganapathi"

Signed and Sealed this
Twenty-sixth Day of November, 2013

Margaret A. Focarino

Margaret A. Focarino
*Commissioner for Patents of the United States Patent and Trademark Office*

UNITED STATES PATENT AND TRADEMARK OFFICE

CERTIFICATE OF CORRECTION

PATENT NO. : 8,549,856 B1
APPLICATION NO. : 12/902883
DATED : October 8, 2013
INVENTOR(S) : Cepeda-Rizo et al.

It is certified that error appears in the above-identified patent and that said Letters Patent is hereby corrected as shown below:

On the title page, item [12] should read "Cepeda-Rizo et al."

On the title page, item [75] first inventor's name should read "Juan Cepeda-Rizo" and the second inventor's name should read "Gani B. Ganapathi"

This certificate supersedes the Certificate of Correction issued November 26, 2013.

Signed and Sealed this
Fourth Day of February, 2014

Michelle K. Lee

Michelle K. Lee
*Deputy Director of the United States Patent and Trademark Office*